US006029950A

United States Patent [19]

Yeh

[11] Patent Number: 6,029,950

[45] Date of Patent: Feb. 29, 2000

[54] JACK ASSEMBLY

[75] Inventor: Neng-Chen Yeh, Tainan Hsien, Taiwan

[73] Assignee: Tai E International Patent & Law Office, Taipei, Taiwan

[21] Appl. No.: 09/244,537

[22] Filed: Feb. 4, 1999

[51] Int. Cl.[7] ..... B66F 3/00

[52] U.S. Cl. ..... 254/126; 254/DIG. 2; 254/425

[58] Field of Search ..... 254/126, DIG. 2, 254/DIG. 9, 425

[56] References Cited

U.S. PATENT DOCUMENTS

| | | | |
|---|---|---|---|
| 3,451,655 | 6/1969 | Scott | 254/126 |
| 5,165,660 | 11/1992 | Engel et al. | 254/126 |
| 5,364,072 | 11/1994 | Engel | 254/126 |
| 5,613,670 | 3/1997 | Ballestrazzi et al. | 271/3.23 |
| 5,624,340 | 4/1997 | Forster | 475/72 |

*Primary Examiner*—Timothy V. Eley
*Assistant Examiner*—Benjamin M. Halpern
*Attorney, Agent, or Firm*—Gardere & Wynne, LLP

[57] ABSTRACT

A jack assembly includes two lower arms each having an upper end portion and a lower end portion pivotally attached to a base, two upper arms each having an upper end portion pivotally mounted to a support bracket and a lower end portion pivotally mounted to the upper end portion of one of the two respective lower arms, a drive shaft having two end portions each rotatably extending through the connection of the lower end portion of one of the two respective upper arms and the upper end portion of one of the two respective lower arms, and an drive device including a drive gear train driven by a motor so as to rotate the drive shaft electrically, and a drive nut driven by a tool such as a socket so as to rotate the drive shaft manually. In such a manner, the jack assembly can be operated manually or electrically.

11 Claims, 5 Drawing Sheets

JACK ASSEMBLY

CROSS-REFERENCES TO RELATED APPLICATIONS

Not Applicable.

BACKGROUND OF THE INVENTION

1. Field of the Invention

The present invention relates to a jack assembly, and more particularly to a jack assembly, which can be operated electrically or manually.

2. Description of the Related Art

A conventional jack assembly (50) in accordance with the prior art shown in FIG. 4 comprises two lower arms (52) each having an upper end portion and a lower end portion pivotally attached to a base (51), two upper arms (520) each having an upper end portion pivotally mounted to a support bracket (54) and a lower end portion pivotally mounted to the upper end portion of one of the two lower arms (52), and a drive shaft (55) rotatably mounted between the lower arms (52) and the upper arms (520), and having a first end portion (57) in which a rod (58) is inserted to rotate the drive shaft (55), and a second end portion formed with an outer thread (56) and rotatably mounted in an elbow (53). The elbow (53) is mounted to the lower arm (52) and the upper arm (520), and has an inner thread (not shown) mating with the outer thread (56) of the drive shaft (55) such that the elbow (53) displaces relative to the drive shaft (55) when the drive shaft (55) is rotated.

In operation, the rod (58) can be rotated so as to rotate the drive shaft (55) whose rotation causes the elbow (53) to displace such that each of the two upper arms (520) is pivoted relative to the respective lower arm (52), thereby lifting the support bracket (54) which can be used to lift an object such as the chassis of a car so as to inspect the chassis for maintenance of the car or to replace an tire of the car. In such a manner, the jack assembly (50) is operated manually. However, it requires a great deal of time and effort to operate the jack assembly (50) manually, thereby causing inconvenience to the user.

A second conventional jack assembly (60) in accordance with the prior art shown in FIG. 5 comprises two lower arms (62) each having an upper end portion and a lower end portion pivotally attached to a base (61), two upper arms (620) each having an upper end portion pivotally mounted to a support bracket (64) and a lower end portion pivotally mounted to the upper end portion of one of the two lower arms (62), and a drive shaft (65) rotatably mounted between the lower arms (62) and the upper arms (620), and having a first end portion to which an electric drive (66) is attached to rotate the drive shaft (65), and a second end portion formed with an outer thread (not shown) and rotatably mounted in an elbow (63). The elbow (63) is mounted to the lower arm (62) and the upper arm (620), and has an inner thread (not shown) mating with the outer thread of the drive shaft (65) such that the elbow (63) displaces relative to the drive shaft (65) when the drive shaft (65) is rotated.

In operation, the electric drive (66) includes a plug (67) which can be inserted into a receptacle (not shown) of the power supply (not shown) of a car so as to operate the electric drive (66) which rotates the drive shaft (65) whose rotation causes the elbow (63) to displace such that each of the two upper arms (620) is pivoted relative to the respective lower arm (62), thereby lifting the support bracket (64) which can be used to lift the chassis so as to inspect the chassis for maintenance of the car or to replace a tire of the car. In such a manner, the jack assembly (60) is operated electrically. However, the electric drive (66) stops its operation when the power supply is dead due to the car failing such that the jack assembly (60) cannot be operated, thereby limiting the versatility of the jack assembly (60). In addition, the electric drive (66) secured on the upper arms (620) cannot be removed therefrom.

The present invention has arisen to mitigate and/or obviate the disadvantage of the conventional jack assembly.

BRIEF SUMMARY OF THE INVENTION

In accordance with one aspect of the present invention, there is provided a jack assembly comprising: a base; two lower arms each having an upper end portion and a lower end portion, the lower end portion pivotally attached to the base; two upper arms each having an upper end portion and a lower end portion, the lower end portion pivotally mounted to the upper end portion of one of the two corresponding lower arms; a support bracket pivotally mounted to the upper end portion of each of the two upper arms; a drive shaft rotatably mounted between the lower arms and the upper arms, and having two end portions each rotatably extending through the connection of the lower end portion of one of the two corresponding upper arms and the upper end portion of one of the two corresponding lower arms; and a drive device mounted to one of the two end portions of the drive shaft and comprising: a housing secured to the one end portion of the drive shaft, and the one end portion of the drive shaft extending outward from the housing; a drive gear train rotatably received in the housing and secured to the one end portion of the drive shaft to rotate the drive shaft; and a drive nut secured to the one end portion of the drive shaft extending outward from the housing to rotate the drive shaft.

Further benefits and advantages of the present invention will become apparent after a careful reading of the detailed description with appropriate reference to the accompanying drawings.

DETAILED DESCRIPTION OF THE INVENTION

Figure 1:
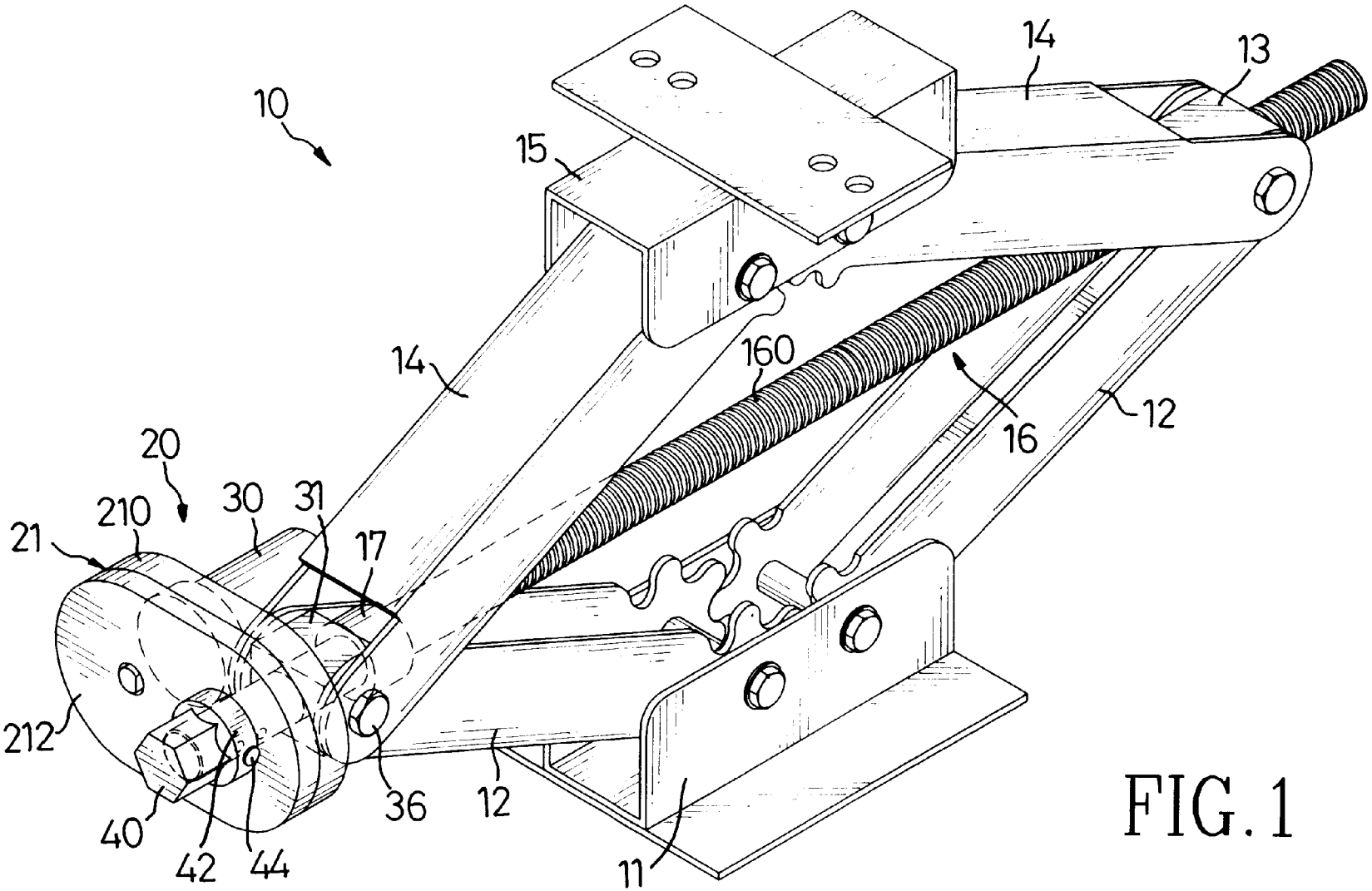
FIG. 1 is a perspective view of a jack assembly in accordance with the present invention.
Figure 2:
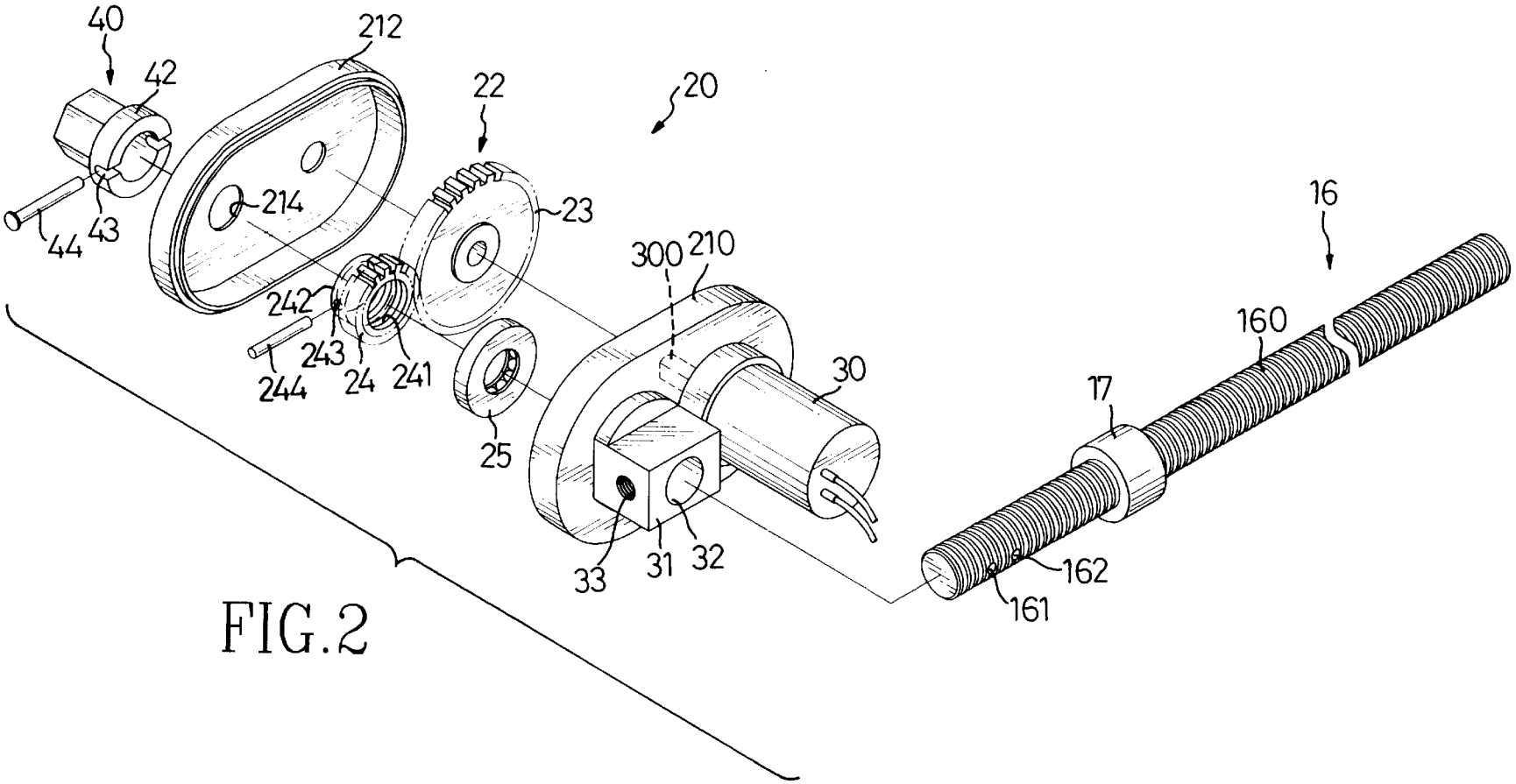
FIG. 2 is a partially exploded perspective view of the jack assembly as shown in FIG. 1.
Figure 3:
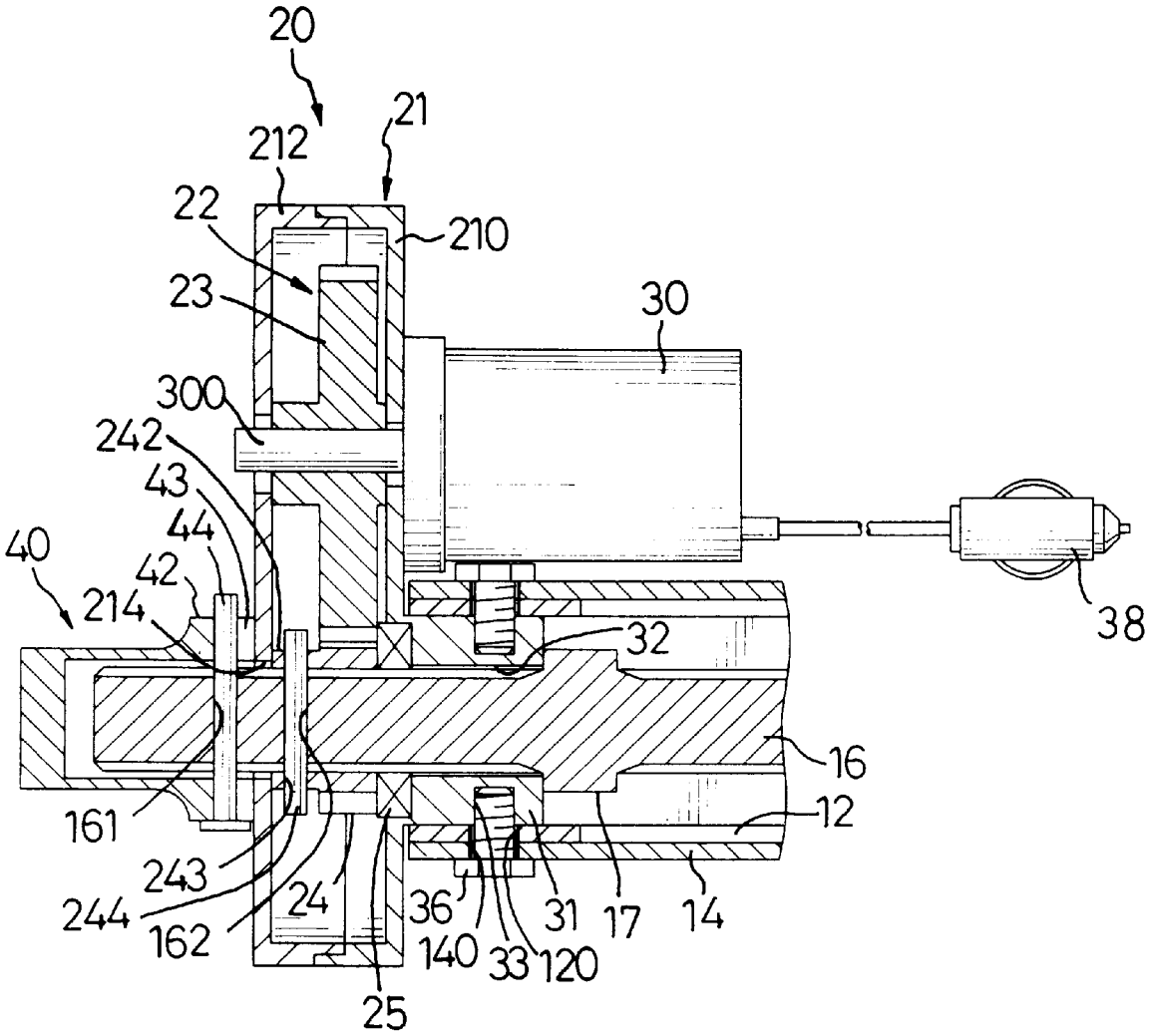
FIG. 3 is a top plan cross-sectional view of the jack assembly as shown in FIG. 1.
Figure 4:
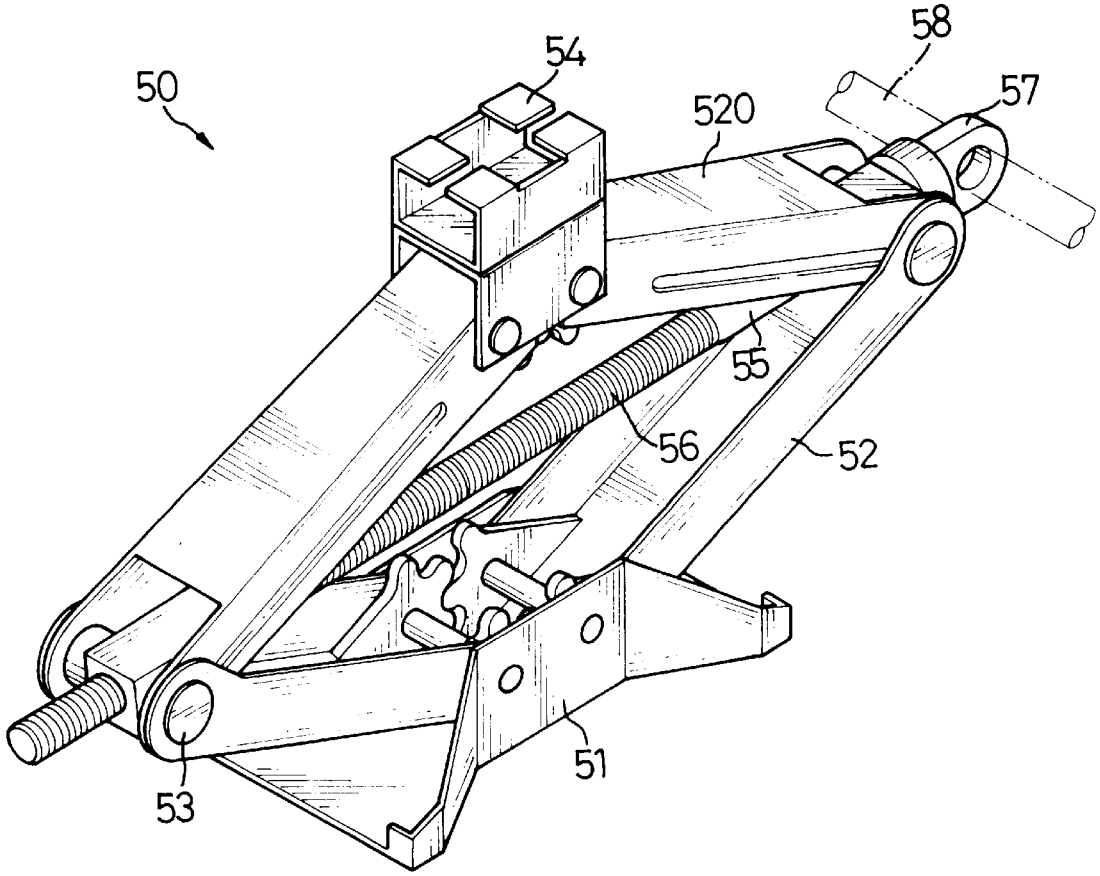
FIG.4 PRIOR ART
FIG. 4 is a perspective view of a first conventional jack assembly in accordance with the prior art.
Figure 5:
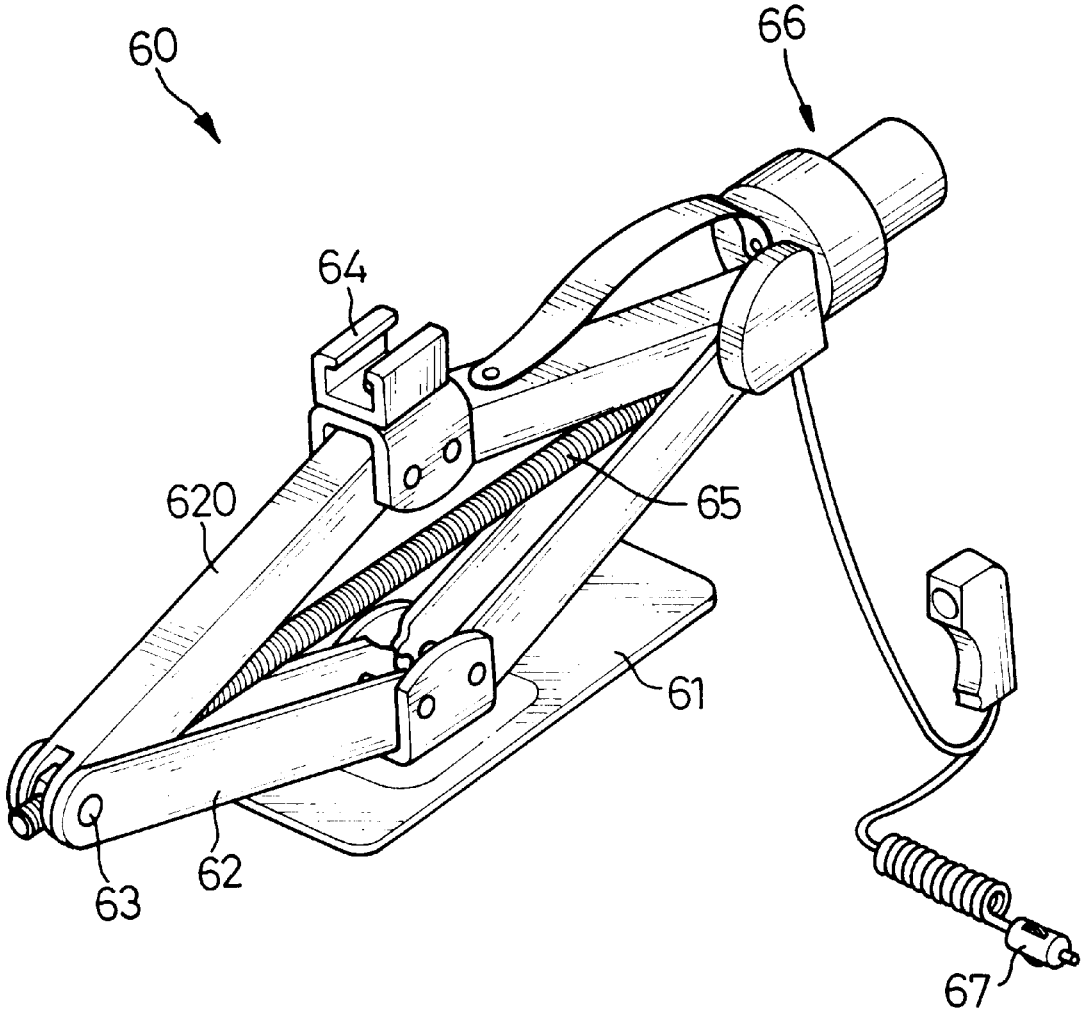
FIG.5 PRIOR ART
FIG. 5 is a perspective view of a second conventional jack assembly in accordance with the prior art.

Referring now to FIGS. 1–3, a jack assembly in accordance with the present invention comprises a base (11), two lower arms (12) each having an upper end portion and a lower end portion pivotally attached to the base (11), two upper arms (14) each having an upper end portion and a lower end portion pivotally mounted to the upper end portion of one of the two corresponding lower arms (12), a support bracket (15) pivotally mounted to the upper end portion of each of the two upper arms (14), a drive shaft (16) rotatably mounted between the lower arms (12) and the upper arms (14), and having two end portions each rotatably extending through the pivotal connection of the lower end portion of one of the two corresponding upper arms (14) and the upper end portion of one of the two corresponding lower arms (12), an drive device (20) mounted to one of the two end portions of the drive shaft (16) to rotate the drive shaft (16) manually or electrically, and an elbow (13) mounted to the other end portion of the drive shaft (16) and received into the upper end portion of one of the two lower arms (12).

The drive device (20) comprises a housing (21) secured to one end portion of the drive shaft (16), with the one end portion of the drive shaft (16) extending outward from the housing (21), a drive gear train (22) rotatably received in the housing (21) and secured to the one end portion of the drive shaft (16) to rotate the drive shaft (16), means for rotating the drive gear train (22) electrically, and a drive nut (40) secured to the one end portion of the drive shaft (16) extending outward from the housing (21). The drive nut (40) can be received into a tool such as a socket (not shown) so as to rotate the drive shaft (16) manually.

The housing (21) includes a first casing (210) mounted to the connection of the lower end portion of one of the two upper arms (14) and the upper end portion of one of the two lower arms (12) for rotatably receiving the drive shaft (16) therein, and a second casing (212) attached to the first casing (210) and containing a hole (214) for rotatably receiving the drive shaft (16) therein, wherein the one end portion of the drive shaft (16) extends outward from the second casing (212).

One of the two lower arms (12) contains a first hole (120) defined in the upper end portion thereof, and one of the two upper arms (14) contains a second hole (140) defined in the lower end portion thereof and aligning with the first hole (120). The housing (21) includes a retaining block (31) extending from the first casing (210) and received into the upper end portion of the lower arm (12), a through hole (32) longitudinally defined in the retaining block (31) for rotatably receiving the drive shaft (16) therein, a threaded bore (33) transversely contained in the retaining block (31) and aligning with the first hole (120), a bearing (25) mounted between the drive shaft (16) and the retaining block (31), and a fastening bolt (36) in turn extending through the second hole (140) and the first hole (120), and screwed into the threaded bore (33), thereby securing the retaining block (31) of the housing (21) to the upper arm (14) and the lower arm (12). The drive shaft (16) includes an annular flange (17) mounted on one of the two end portions thereof and rotatably abutting the retaining block (31).

The means for rotating the drive gear train (22) includes a motor (30) secured to the first casing (210) of the housing (21) for rotating the drive gear train (22). The motor (30) includes a motor axle (300) rotatably extending through the first casing (210), and the drive gear train (22) includes a drive gear (23) secured on the motor axle (300) to rotate therewith, and a driven gear (24) meshing with and rotated by the drive gear (23), and secured on the drive shaft (16) to rotate the drive shaft (16).

The drive shaft (16) has an outer thread (160) formed thereon, and the driven gear (24) contains an inner thread (241) longitudinally defined therein and screwed on the outer thread (160) of the drive shaft (16).

The drive shaft (16) contains a locking hole (162) defined in one of the two end portions thereof, the driven gear (24) includes a lug (242) extending outward and containing a bore (243) transversely defined therein and aligning with the locking hole (162), and the drive device (20) further comprises a locking pin (244) in turn extending through the bore (243) and the locking hole (162), thereby securing the driven gear (24) to the drive shaft (16) such that the drive shaft (16) can be rotated by the driven gear (24).

The drive shaft (16) also contains a locking hole (161) defined in one of the two end portions thereof, the drive nut (40) includes a lug (42) extending outward and containing a retaining channel (43) transversely defined therein and aligning with the locking hole (161), and the drive device (20) further comprises a locking pin (44) in turn extending through the retaining channel (43) and the locking hole (161), thereby securing the driven nut (40) to the drive shaft (16) such that the drive shaft (16) can be rotated by the drive nut (40).

The elbow (13) includes an inner thread (not shown) screwed on the outer thread (160) of the drive shaft (16) such that the elbow (13) displaces relative to the drive shaft (16) when the drive shaft (16) is rotated.

In operation, the motor (30) includes a plug (38) which can be inserted into a receptacle (not shown) of the power supply (not shown) of a car so as to operate the motor (30) which rotates the drive gear (23) which rotates the driven gear (24) which in turn rotates the drive shaft (16) whose rotation causes the elbow (13) to displace such that each of the two upper arms (14) is pivoted relative to the respective lower arm (12), thereby lifting/lowering the support bracket (15) which can be used to lift an object such as the chassis of a car so as to inspect the chassis for maintenance of the car or to replace a tire of the car. In such a manner, the jack assembly is operated electrically. Alternatively, a tool such as a socket (not shown) can be fitted onto the drive nut (40) so as to rotate the drive shaft (16). In such a manner, the jack assembly is operated manually.

Accordingly, the jack assembly in accordance with the present invention can be operated electrically or manually.

The motor (30) stops its operation when the power supply is dead due to the car failing such that the drive gear (23) and the driven gear (24) will stop rotating. However, the drive gear (23) and the driven gear (24) are both designed as smaller gears such that the manual rotation of the drive nut (40) is large enough to overcome the torque exerted on the drive shaft (16) by the reaction of the drive gear (23) and the driven gear (24).

In addition, the drive shaft (16) can be easily removed from the upper arms (14) and the lower arms (12), thereby increasing the facility of replacing the drive shaft (16).

It should be clear to those skilled in the art that further embodiments may be made without departing from the scope and spirit of the present invention.

What is claimed is:

1. A jack assembly comprising:

a base (11);

two lower arms (12) each having an upper end portion and a lower end portion, said lower end portion pivotally attached to said base (11);

two upper arms (14) each having an upper end portion and a lower end portion, said lower end portion pivotally mounted to said upper end portion of one of said two corresponding lower arms (12);

a support bracket (15) pivotally mounted to said upper end portion of each of said two upper arms (14);

a drive shaft (16) rotatably mounted between said lower arms (12) and said upper arms (14), and having two end portions each rotatably extending through the connection of said lower end portion of one of said two corresponding upper arms (14) and said upper end portion of one of said two corresponding lower arms (12), said drive shaft (16) containing a locking hole (161) defined in one of the two end portions thereof; and a drive device (20) mounted to one of said two end portions of said drive shaft (16) and comprising:

a housing (21) secured to said one end portion of said drive shaft (16), and said one end portion of said drive shaft (16) extending outward from said housing (21);

a drive gear train (22) rotatably received in said housing (21) and secured to said one end portion of said drive shaft (16) to rotate said drive shaft (16); and a drive nut (40) secured to said one end portion of said drive shaft (16) extending outward from said housing (21) to rotate said drive shaft (16), said drive nut (40) including a lug (42) extending outward and containing a retaining channel (43) transversely defined therein and aligning with said locking hole (161); and a locking pin (44) in turn extending through said retaining channel (43) and said locking hole (161), thereby securing said driven nut (40) to said drive shaft (16).

2. The jack assembly in accordance with claim 1, wherein said housing (21) including a first casing (210) mounted to the connection of said lower end portion of one of said two upper arms (14) and said upper end portion of one of said two lower arms (12) for rotatably receiving said drive shaft (16) therein, and a second casing (212) attached to said first casing (210) for rotatably receiving said drive shaft (16) therein, wherein said one end portion of said drive shaft (16) extends outward from said second casing (212).

3. The jack assembly in accordance with claim 2, wherein one of said two lower arms (12) contains a first hole (120) defined in the upper end portion thereof, one of said two upper arms (14) contains a second hole (140) defined in the lower end portion thereof and aligning with said first hole (120), said housing (21) includes a retaining block (31) extending from said first casing (210) and received into said upper end portion of said one lower arm (12), a threaded bore (33) transversely contained in said retaining block (31) and aligning with said first hole (120), and a fastening bolt (36) in turn extending through said second hole (140), said first hole (120), and screwed into said threaded bore (33).

4. The jack assembly in accordance with claim 3, wherein said retaining block (31) contains a through hole (32) longitudinally defined therein for rotatably receiving said drive shaft (16).

5. The jack assembly in accordance with claim 4, further comprising a bearing (25) mounted between said drive shaft (16) and said retaining block (31).

6. The jack assembly in accordance with claim 3, wherein said drive shaft (16) includes an annular flange (17) mounted on one of the two end portions thereof and rotatably abutting said retaining block (31).

7. The jack assembly in accordance with claim 2, further comprising means for rotating said drive gear train (22).

8. The jack assembly in accordance with claim 7, wherein said means for rotating said drive gear train (22) includes a motor (30) secured to said first casing (210) of said housing (21) for rotating said drive gear train (22).

9. The jack assembly in accordance with claim 8, wherein said motor (30) includes a motor axle (300) rotatably extending through said first casing (210), and said drive gear train (22) includes a drive gear (23) secured on said motor axle (300) to rotate therewith, and a driven gear (24) meshing with and rotated by said drive gear (23), and secured on said drive shaft (16) for rotating said drive shaft (16).

10. The jack assembly in accordance with claim 9, wherein said drive shaft (16) contains a locking hole (162) defined in one of the two end portions thereof, said driven gear (24) includes a lug (242) extending outward and containing a bore (243) transversely defined therein and aligning with said locking hole (162), and said drive device (20) further comprises a locking pin (244) in turn extending through said bore (243) and said locking hole (162), thereby securing said driven gear (24) to said drive shaft (16).

11. The jack assembly in accordance with claim 9, wherein said drive shaft (16) has an outer thread (160) formed thereon, and said driven gear (24) contains an inner thread (241) longitudinally defined therein and screwed on said outer thread (160) of said drive shaft (16).

* * * * *

UNITED STATES PATENT AND TRADEMARK OFFICE

CERTIFICATE OF CORRECTION

PATENT NO. : 6,029,950
DATED : February 29, 2000
INVENTOR(S) : Neng-Chen Yeh

It is certified that error appears in the above-identified patent and that said Letters Patent is hereby corrected as shown below:

Title page,
Item [73], Assignee, please delete:

"Tai E International Patent & Law Office, Taipei, Taiwan".

Signed and Sealed this

Eleventh Day of February, 2003

JAMES E. ROGAN
*Director of the United States Patent and Trademark Office*